US009893467B2

(12) United States Patent
Chen et al.

(10) Patent No.: US 9,893,467 B2
(45) Date of Patent: Feb. 13, 2018

(54) CONNECTOR POSITION ASSURANCE DEVICE, A CONNECTOR APPARATUS HAVING MALE AND FEMALE CONNECTOR ASSEMBLIES WITH TERMINAL POSITION ASSURANCE DEVICES AND THE CONNECTOR POSITION ASSURANCE DEVICE, A MALE CONNECTOR ASSEMBLY, A FEMALE CONNECTOR ASSEMBLY, AND A METHOD FOR ASSEMBLING THE CONNECTOR APPARATUS

(71) Applicant: J.S.T. CORPORATION, Farmington Hills, MI (US)

(72) Inventors: Ping Chen, Farmington Hills, MI (US); Jong Kim, Farmington Hills, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 15/271,490

(22) Filed: Sep. 21, 2016

(65) Prior Publication Data

US 2017/0170601 A1 Jun. 15, 2017

Related U.S. Application Data

(60) Provisional application No. 62/266,294, filed on Dec. 11, 2015.

(51) Int. Cl.
*H01R 13/627* (2006.01)
*H01R 13/639* (2006.01)
(Continued)

(52) U.S. Cl.
CPC ..... *H01R 13/639* (2013.01); *H01R 13/426* (2013.01); *H01R 13/4362* (2013.01); *H01R 13/6271* (2013.01); *H01R 43/26* (2013.01)

(58) Field of Classification Search
CPC ..... H01R 13/641; H01R 13/6272
(Continued)

(56) References Cited

U.S. PATENT DOCUMENTS 4,302,066 A * 11/1981 Newman ..... H01R 13/6395 439/347
4,634,204 A * 1/1987 Detter ..... H01R 13/641 439/347

(Continued)

*Primary Examiner* — Neil Abrams
(74) *Attorney, Agent, or Firm* — Kratz, Quintos & Hanson, LLP

(57) ABSTRACT

A connector position assurance (CPA) device for assuring and for informing a user of the engagement of a female connector assembly and a male connector assembly in a connector apparatus, and the connector apparatus having the female connector assembly and the male connector assembly engaged together, when in full-lock position, by the CPA. The female and male connector assemblies having a female terminal position assurance (TPA) device and a male terminal position assurance (TPA) device. During transport, the female TPA is engaged, in a pre-set position or a pre-lock position, to the female connector assembly, while the male TPA is engaged, in a pre-set position or a pre-lock position, to the male connector assembly. Also during transport, a connector position assurance (CPA) device is, at a pre-set position or a pre-lock position, with the female connector assembly (FIG. 13A). At least a set of terminals is provided into each of the male connector assembly and the female connector assembly when each of their respective male TPA and female TPA is at a pre-set position or a pre-lock position. The set of terminals provided for the male connector assembly is secured thereto when the male TPA thereof is placed at a full-lock position. Similarly, the set of terminals provided for the female connector assembly is secured thereto when the female TPA thereof is placed at a full-lock position. Thereafter, the male connector assembly and female connector assembly are engaged together, and the engage- (Continued)

ment thereof is assured when the CPA device is pushed downward and placed at a full-lock position (FIG. 13B) and when a leg of the CPA blocks the inward movement of a flexible member of the female connector assembly.

25 Claims, 12 Drawing Sheets

(51) Int. Cl.
*H01R 13/426* (2006.01)
*H01R 43/26* (2006.01)
*H01R 13/436* (2006.01)

(58) Field of Classification Search
USPC ..... 439/352, 489, 595, 752
See application file for complete search history.

(56) References Cited

U.S. PATENT DOCUMENTS 4,797,116 A * 1/1989 Isohata ..... H01R 13/631 439/141
4,871,323 A * 10/1989 Ohsumi ..... H01R 13/639 439/188
4,979,116 A * 12/1990 Takahashi ..... B62D 7/159 180/415
5,462,449 A * 10/1995 Tsuji ..... H01R 13/641 439/188
5,520,553 A * 5/1996 Cecil, Jr. ..... H01R 13/4365 439/595
5,605,471 A * 2/1997 Plyler ..... H01R 13/641 439/352
5,803,756 A * 9/1998 Furutani ..... H01R 13/7032 200/51.1
6,716,052 B2 * 4/2004 Kane ..... H01R 13/641 439/352
6,811,424 B2 * 11/2004 Seminara ..... H01R 13/6273 439/188
7,399,195 B2 * 7/2008 Kim ..... H01R 13/6272 439/352
7,670,177 B2 * 3/2010 Myer ..... H01R 13/4365 439/595
8,016,606 B1 * 9/2011 Kwan ..... H01R 13/641 439/352
8,376,773 B2 * 2/2013 Ma ..... H01R 13/639 439/347
8,764,472 B2 * 7/2014 Rassoolkhani ..... H01R 13/62 439/347
9,281,619 B2 * 3/2016 Morello ..... H01R 13/6272
9,425,534 B2 * 8/2016 Schmidt ..... H01R 13/6272
2017/0170601 A1 * 6/2017 Chen ..... H01R 13/639

* cited by examiner

CONNECTOR POSITION ASSURANCE DEVICE, A CONNECTOR APPARATUS HAVING MALE AND FEMALE CONNECTOR ASSEMBLIES WITH TERMINAL POSITION ASSURANCE DEVICES AND THE CONNECTOR POSITION ASSURANCE DEVICE, A MALE CONNECTOR ASSEMBLY, A FEMALE CONNECTOR ASSEMBLY, AND A METHOD FOR ASSEMBLING THE CONNECTOR APPARATUS

CROSS-REFERENCE TO RELATED APPLICATIONS

This patent application claims priority to U.S. Provisional Patent Application No. 62/266,294, filed Dec. 11, 2015, which is hereby incorporated herein by reference in its entirety.

BACKGROUND OF THE INVENTION

The present invention generally relates to a connector position assurance (CPA) device for assuring the engagement of male and female connector assemblies, a connector apparatus having the male connector assembly and the female connector assembly, the male connector assembly having a male terminal position assurance (TPA) device for connecting thereto at least a set of terminals, and the female connector assembly having a female terminal position (TPA) device for connecting thereto at least a set of terminals. The female connector assembly further includes the CPA device for locking the male and female connector assemblies together.

SUMMARY OF THE INVENTION

To ensure that the male terminal position assurance (TPA) device is made available for connecting to the male connector assembly during transport thereof, the male TPA is engaged, in a pre-set position or a pre-lock position, to the male connector assembly. Also, to ensure that the female terminal position assurance (TPA) device is made available for connecting to the female connector assembly during transport thereof, the female TPA is engaged, in a pre-set position or a pre-lock position, to the female connector assembly.

In addition to the female TPA at a pre-set position or a pre-lock position engagement with the female connector assembly, the female connector assembly engages thereto, during the transport thereof, with the connector position assurance (CPA) device at a pre-set position or a pre-lock position.

At least a terminal is provided into each of the male connector assembly and the female connector assembly, when each of their respective male TPA and female TPA is at a pre-set position or a pre-lock position. The male connector assembly and female connector assembly are engaged together, and the engagement thereof is assured when the CPA device is placed at a full-lock position. The set of terminals provided for the male connector assembly is secured thereto when the male TPA thereof is placed at a full-lock position. Similarly, the set of terminals provided for the female connector assembly is secured thereto when the female TPA thereof is placed at a full-lock position.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanations without limiting the scope of the invention as claimed.

DETAILED DESCRIPTION OF THE PREFERRED EMBODIMENTS

Figure 1:
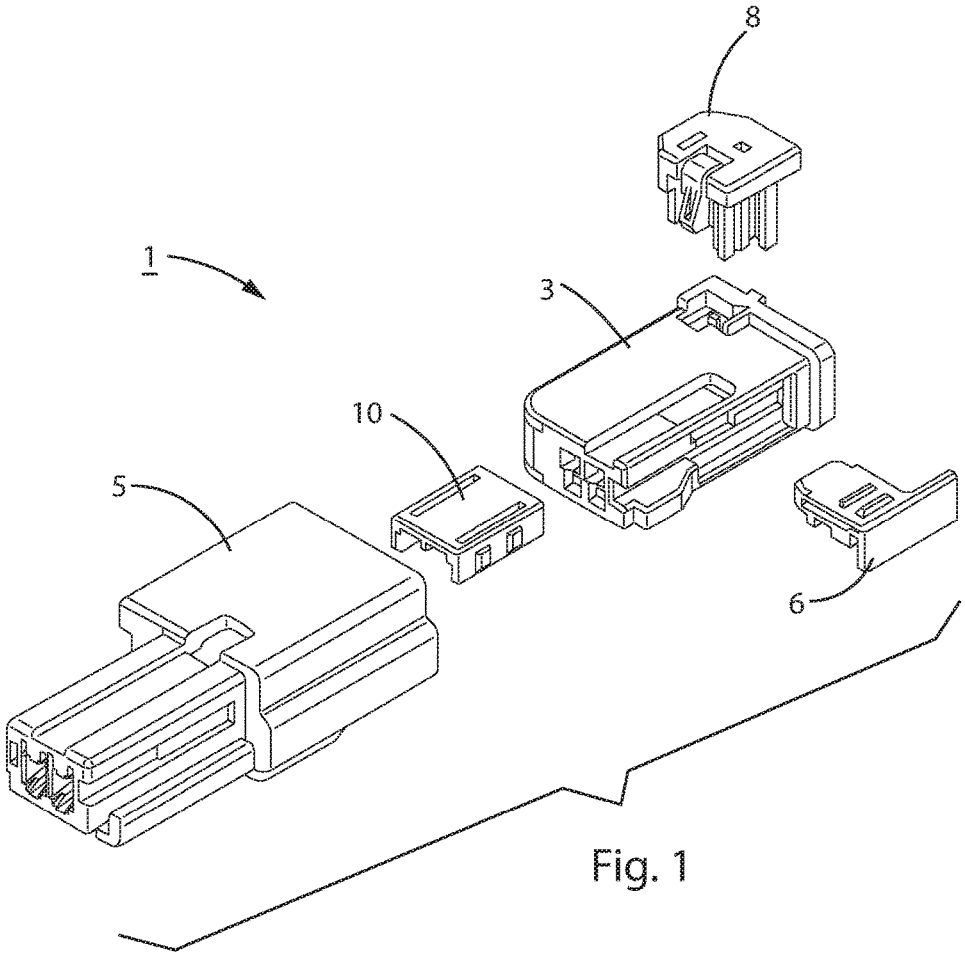
FIG. 1 is an exploded perspective view of the connector apparatus of the present invention having male and female connector assemblies, along with their respective terminal position assurance (TPA) devices.

FIG. 1 illustrates, in an exploded perspective view, the connector apparatus, generally referred to by reference number 1, which includes a female connector assembly 3 and a male connector assembly 5. The female connector assembly 3 includes a female terminal position assurance (TPA) device 6 and a connector position assurance (CPA) device 8. The male connector assembly 5 includes a male terminal position assurance (TPA) device 10.

Figure 2A:
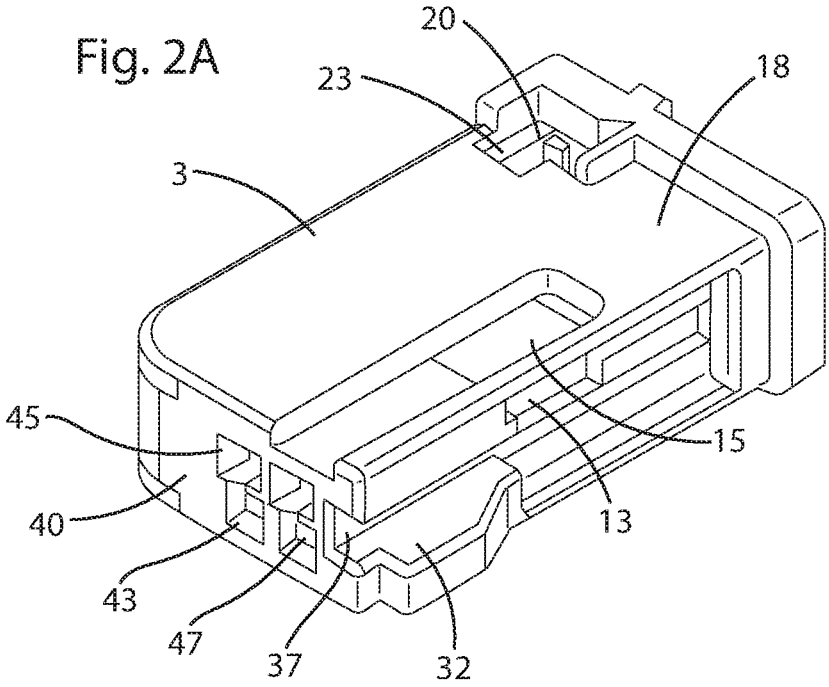
FIG. 2A is a top perspective view of the female connector assembly.
Figure 2B:
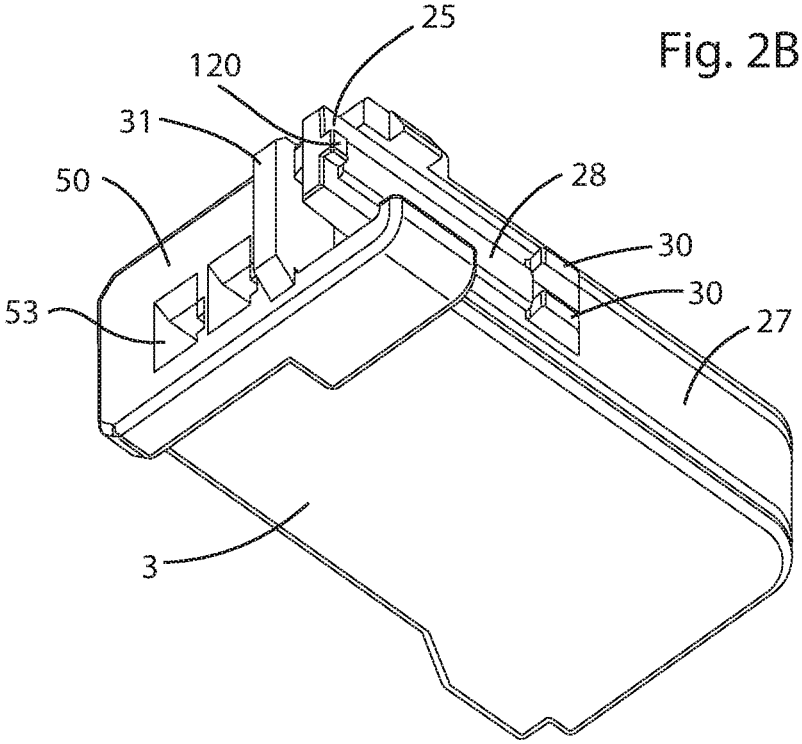
FIG. 2B is a bottom perspective view of the female connector assembly.

FIGS. 2A and 2B illustrate the female connector assembly 3, which includes a side slot 13 on a side thereof and a top slot 15 on a top side 18 thereof. A corner slot 20 is provided through a corner portion 23 of the top side 18 of the female connector assembly 3. As explained later, the side slot 13 receives the female terminal assurance (TPA) device 6, while the corner slot 20 receives the CPA device 8.

An elongated flexible member 25 (see, FIG. 2B) extends partially or entirely along a side 27 of the female connector assembly 3 and is preferably integral thereto. Extending from a side 28 of the elongated flexible member 25 are a pair of protruding members 30 and extending from a side end portion of the elongated flexible member 25 is a protrusion 120, the significance of which are explained later. Although a pair of protruding members 30 are shown, a single protruding member may be employed. A ledge portion 32 (see, FIG. 2A) extends from an opposite side 37 of the female connector assembly 3.

At an end portion 40 of the female connector assembly 3 (see, FIG. 2A), terminal apertures 43, which include a set of upper apertures 45 and a set of lower apertures 47, are provided. Another end portion 50 (see, FIG. 2B) of the female connector assembly 3 includes another set of apertures 53 for receiving therein at least a set of terminals (not shown). As further shown in FIG. 2B, an elongated protrusion 31 extends along the end portion 50 of the female connector assembly 3.

Figure 3:
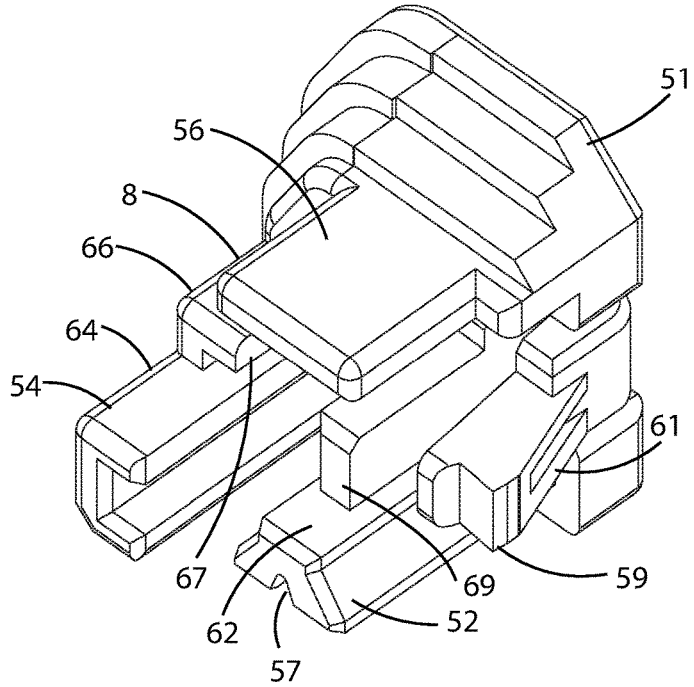
FIG. 3 is a perspective view of the connector position assurance (CPA) device of the female connector assembly.

FIG. 3 shows the CPA device 8 having an upper portion 51. Extending from the upper portion 51 are a first leg portion 52, a second leg portion 54, and a third leg portion 56. The first leg portion 52 is substantially V-shaped with an elongated indentation 57 extending along thereon. The bottom portion of the V-shaped first leg portion 52 includes a blocking member 62 and a ledge portion 69 for assisting in ensuring that, as more fully discussed later, the elongated flexible member 25 of the female connector assembly 3 does not move inward. The second leg portion 54 includes a long portion 64 and short portion 66, the long portion 64 being substantially U-shaped, and the short portion 66 being substantially L-shaped with an exposed inside surface 67. Further extending from the upper portion 51 of the CPA device 8 is a flexible leg 59 having a substantially tapered external surface 61.

As discussed later, the first leg portion 52, the second leg portion 54, the third leg portion 56, and the flexible leg 59 interface with the corner slot 20 passing through the corner portion 23 of the top side 18 of the female connector assembly 3 when the CPA device 8 is inserted into the corner slot 23. As further discussed later, the CPA device 8, with the above-described features and structural arrangements, allows the CPA device 8 to be in the pre-set position (or the pre-lock) position and the full-lock position when inserted into the corner slot 20 passing through the corner portion 23 of the top side 18 of the female connector assembly, the full-lock position of the CPA device 8 assuring the full engagement, and subsequent locking, of the female connector assembly 3 to the male connector assembly 5.

Figure 4:
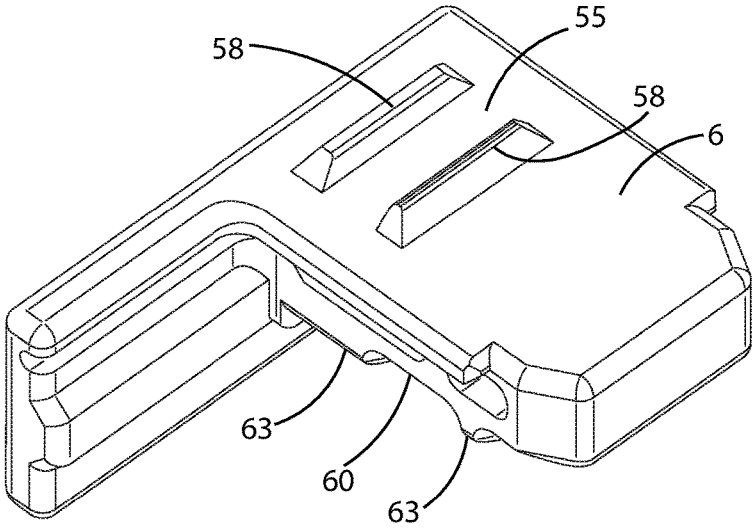
FIG. 4 is a perspective view of the terminal position assurance (TPA) device of the female connector assembly.

FIG. 4 illustrates the TPA device 6 of the female connector assembly 3. Extending from a top portion 55 of the female TPA device 6 are a pair of elongated members 58. Also extending from a bottom portion 60 of the female TPA device 6 are another pair of elongated members 63, which extend, partially or fully, along the bottom portion 60 of the female TPA device 6.

Figure 5A:
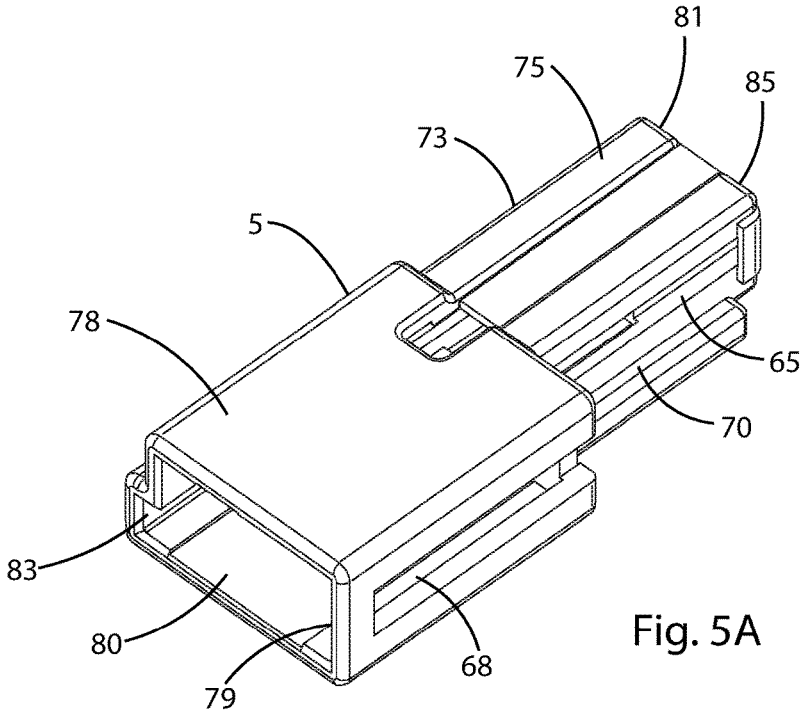
FIG. 5A is a top perspective view of the male connector assembly.
Figure 5B:
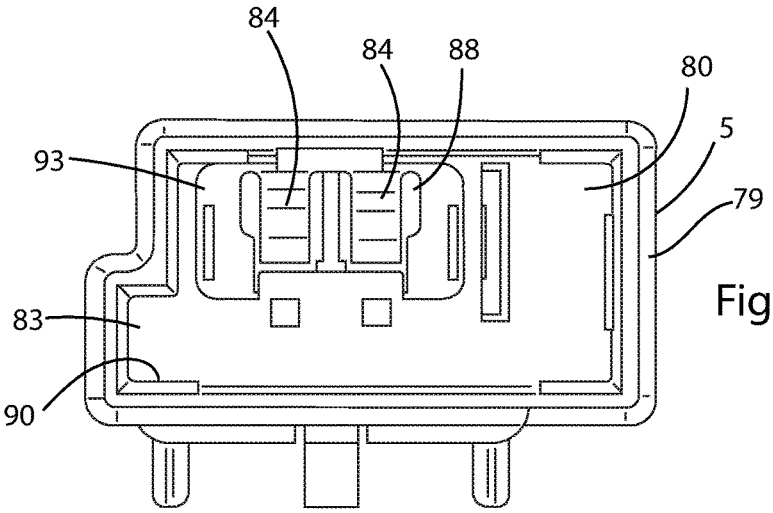
FIG. 5B is a side end elevational view of the male connector assembly.

Shown in FIG. 5A is the male connector assembly 5 having a one end portion 79 and another end portion 81. The male connector assembly 5 includes a first side elongated slot 65 at each of opposing sides 70, 73 of a first part 75 of the male connector assembly 5. A second part 78 of the male connector assembly 5 includes a second side elongated slot 68. An opening 80, for accommodating therein, the female connector assembly 3, has an opening portion 83 with a wider width. When shown at a side end elevational view of the male connector assembly 5 (i.e., when viewed from the opening 80), FIG. 5B illustrates a pair of flexible lance members 84, which extend from an internal upper surface of the end portion 81 of the male connector assembly 5 toward an internal space 88 of the first part 75 of the male connector assembly 5. As discussed later, the flexible lance members 84 crimp the set of terminals (not shown) inserted into a set of terminal apertures at the end portion 81 of the male connector assembly 5 when the male TPA device 10 is inserted through the opening 80 (at the end portion 79) and onto the flexible lance members 84.

As also illustrated in FIG. 5B, the opening portion 83 includes substantially U-shaped side portions 90 for guiding the entry of the female connector assembly 3 through the opening 80 of the male connector assembly 5. Further, the internal space 88 has sides 93 shaped or configured for accommodating and guiding therein the male TPA device 10 upon entry through the opening 80, and consequently through the internal space 88, into the male connector assembly 5.

Figure 6A:
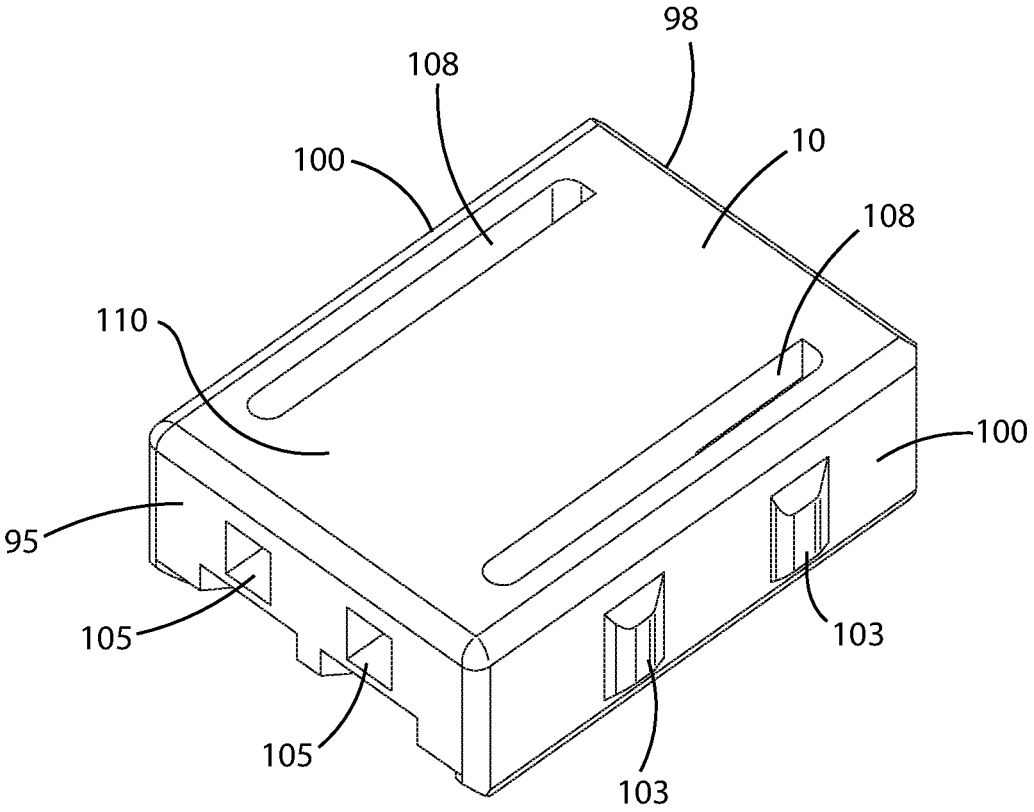
FIG. 6A is a top perspective view of the terminal position assurance (TPA) device of the male connector assembly.

FIG. 6A illustrates the male TPA device 10 having a first end portion 95 and a second end portion 98. On each side 100 of the male TPA device 10 are a pair of protrusions 103, 105, the protrusion 103 being nearer to second end portion 98, and the protrusion 105 being nearer to the first end portion 95. Elongated slots 108 pass through an upper portion 110 of the male TPA device 10, while apertures 105 pass through the first end portion 95 of the male TPA device 10.

Figure 6B:
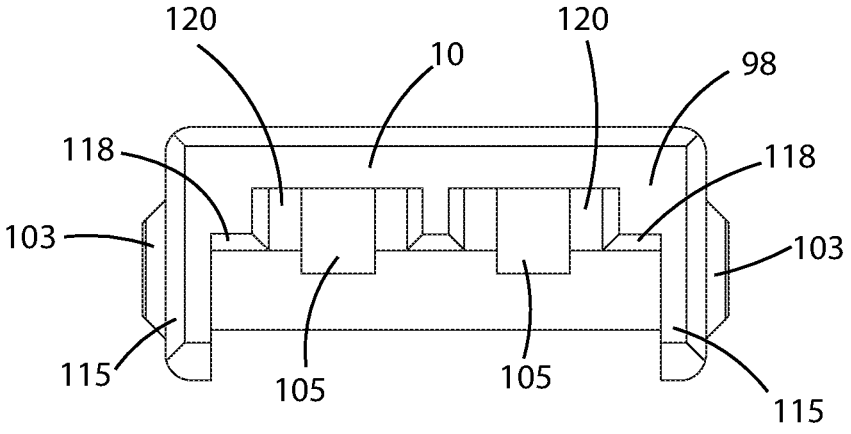
FIG. 6B is a side end elevational view of the TPA device of the male connector assembly.

As seen in FIG. 6B, viewed at an elevational view from the second end portion 98 of the male TPA device 10, the male TPA device 10 includes legs 115 at both sides thereof and internal ledge portions 118. Substantially U-shaped cavities 120 are formed within the internal structure of the male TPA device 10 to correspond to the sides 93 that form the above-described internal space 88, shown in FIG. 5B, of the male connector assembly 5 for allowing the male TPA device 10 to travel and be guided through the internal space 88 of the male TPA device 10 upon entry thereof into the male connector assembly 5.

Figure 7A:
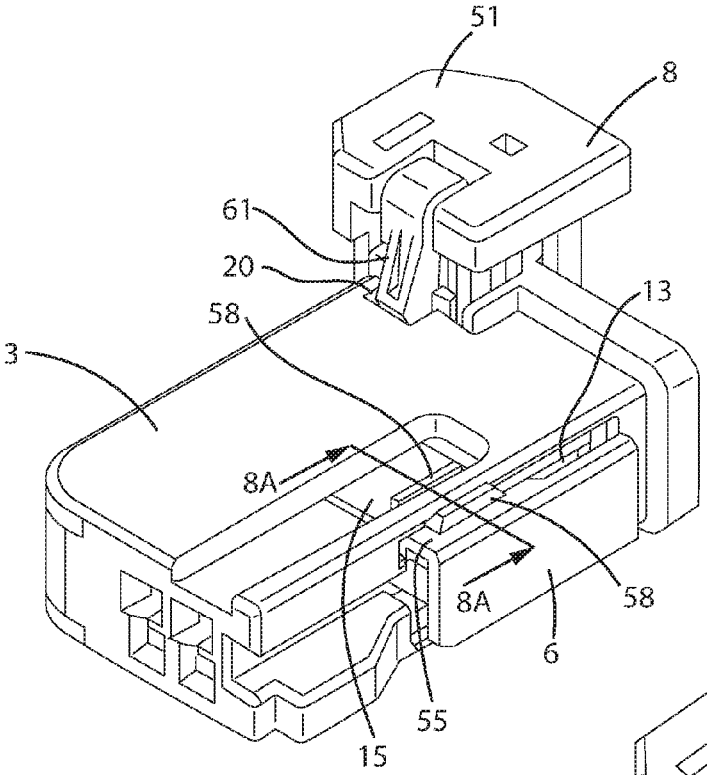
FIG. 7A is a top perspective view of the female connector assembly, having its TPA and CPA both at pre-set positions or pre-lock positions, ready for transport.

The method for assembling the connector apparatus 1 is hereinafter described. As shown in FIG. 7A, the female TPA device 6 is inserted into the side slot 13 of the female connector assembly 3 until one of the pair of elongated members 58, extending from the top portion 55 of the female TPA device 6, is fully inserted into the top slot 15 of the female connector assembly 3, while the other one of the pair of elongated members 58 remains outside of the top slot 15. With the other one of the pair of elongated members 58 of the female TPA device 6 remaining outside of the top slot 15 of the female connector assembly 3 and the female TPA device 6 refraining from being pushed further through the side slot 13 of the female connector assembly 3, the female TPA device 6 is at a pre-lock position.

With the female TPA device 6, at a pre-set position or a pre-lock position, the CPA device 8 is also shown in FIG. 7A in a pre-set position or a pre-lock position. The CPA device 8 remains at a pre-set position or a pre-lock position while its flexible leg 59 remains un-inserted and outside of the corner slot 20 of the female connector assembly 3. With the female TPA device 6 in a pre-set position or a pre-lock position and the CPA device 8 also in a pre-set position or a pre-lock position, the female connector assembly 3 is readily transported as a single unit, which includes thereto the female TPA device 6 and the CPA device 8.

Figure 7B:
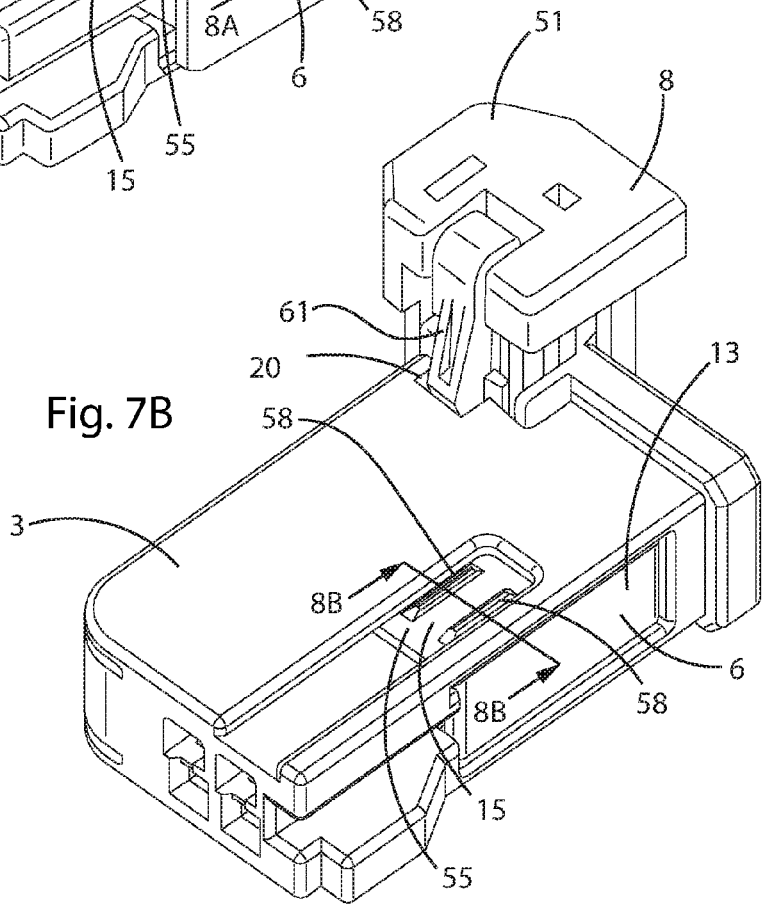
FIG. 7B is a top perspective view of the female connector assembly, having its CPA device in a pre-set position or a pre-lock position and its TPA device in a full-lock position.

In FIG. 7B, the CPA device 8 remains at a pre-set position or a pre-lock position; however, the female TPA device 6 has been completely pushed through the side slot 13 of the female connector assembly 3 and the pair of elongated members 58 have now both been inserted into the top slot 15 of the female connector assembly 3. Thus, the female TPA device 6 is, as shown in FIG. 7B, now in full-lock position.

Figure 8A:
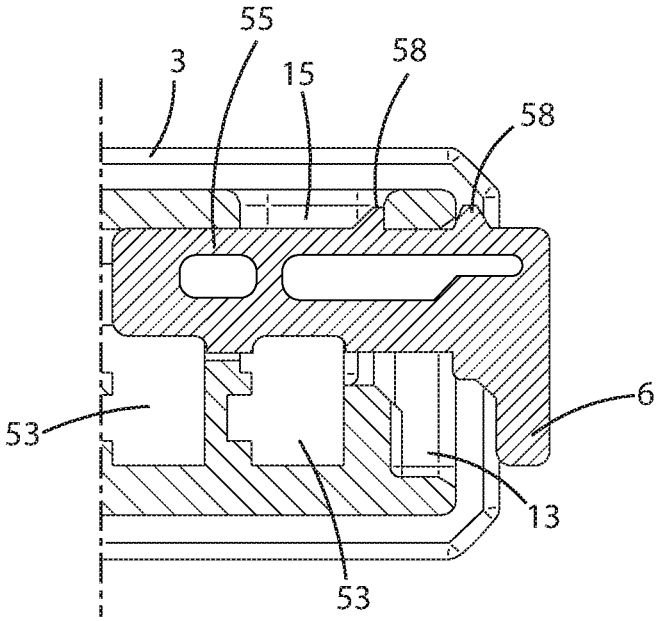
FIG. 8A is a cross-sectional view, taken along line 8A-8A in FIG. 7A, showing the TPA device of the female connector assembly in its pre-set position or pre-lock position.

FIG. 8A is a cross-sectional view, taken along line 8A-8A in FIG. 7A, showing the female TPA device 6 of the female connector assembly 3 in its pre-set position or its pre-lock position. As discussed above, with respect to FIG. 7A, shown in FIG. 8A is one of the pair of elongated members 58, extending from the top portion 55 of the female TPA device 6, fully inserted into the top slot 15 of the female connector assembly 3, while the other one of the pair of elongated members 58 remains outside of the top slot 15. With the other one of the pair of elongated members 58 of the female TPA device 6 remaining outside of the top slot 15 of the female connector assembly 3 and the female TPA device 6 refraining from being pushed further through the side slot 13 of the female connector assembly 3, the female TPA device 6 is at a pre-set position or a pre-lock position.

Figure 8B:
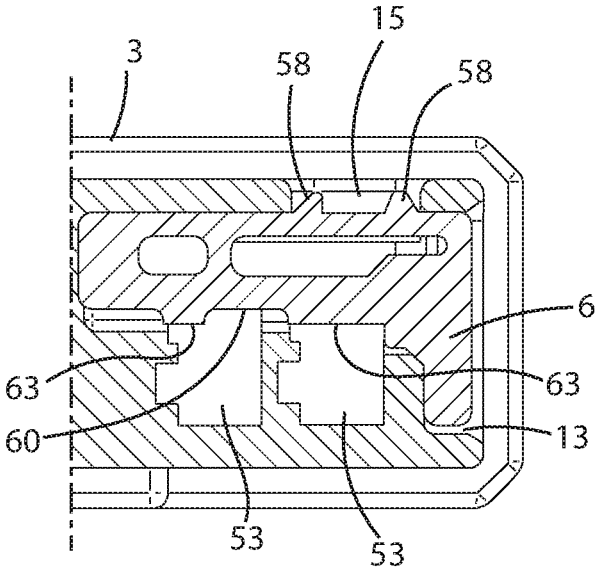
FIG. 8B is a cross-sectional view, taken along line 8B-8B in FIG. 7B, showing the TPA device of the female connector assembly in its full-lock position.

FIG. 8B is a cross-sectional view, taken along line 8B-8B in FIG. 7B, showing the female TPA device 6 of the female connector assembly 3 in its full-lock position. Here, as discussed above with respect to FIG. 7B, the CPA device 8 remains at a pre-set position or a pre-lock position; however, the female TPA device 6 has been completely pushed through the side slot 13 of the female connector assembly 3 and the pair of elongated members 58 have now both been inserted into the top slot 15 of the female connector assembly 3. Thus, the female TPA device 6 is, as shown in FIG. 8B, now in full-lock position.

As can further be seen in FIG. 8B, the pair of elongated members 63, which extend from the bottom portion 60 of the female TPA device 6, are used for crimping a set of terminals (not shown) that pass through the set of apertures 53 at the end portion 50 of the female connector assembly 3. Thus, with the female TPA device 6 being in full-lock position with the female connector assembly 3, the connection of the set of terminals, inserted into the apertures 53, to the female connector assembly 3 is assured.

Figure 9A:
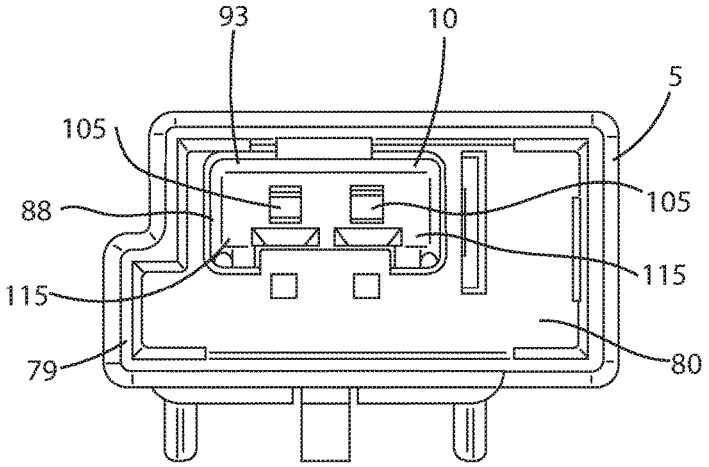
FIG. 9A is a side end elevational view of the male connector assembly with its male TPA inserted and accommodated therein.
Figure 9B:
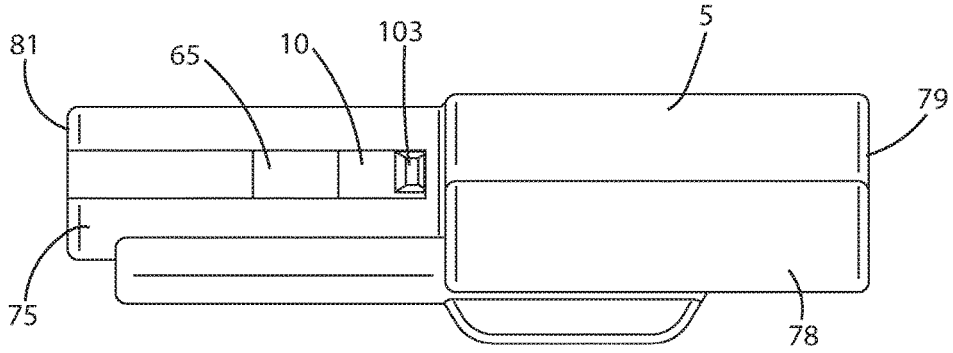
FIG. 9B is a side elevational view of the male connector assembly having its TPA at a pre-set position or a pre-lock position.

Next, illustrated in FIG. 9A is the male TPA device 10 having been inserted through the opening 80 of the male connector assembly 5 and subsequently through the internal space 88 of the male connector assembly 5. The internal space 88 has sides 93, which are shaped or configured for accommodating and guiding therein the male TPA device 10 upon entry through the opening 80, and consequently through the internal space 88, of the male connector assembly 5. The entry of the male TPA device 10 is through the opening 80 at the end portion 79 of the male connector assembly 5. The male TPA device 10, upon entry into the internal space 88, is either pushed independently with a device or by the female connector assembly 3 when the female connector assembly 3 is inserted into the opening 80 of the male connector assembly 5. The male TPA device 10 is pushed through the internal space 88 until one protrusion 103 of the pair of protrusions 103, 105 is inserted through the elongated slot 65. It is noted that the pair of protrusions 103, 105 extend on each side 100 of the male TPA device 10, and the side elongated slot 65 exists at each of the opposing sides 70, 73 of the first part 75 of the male connector assembly 5. When the one protrusion 103 of the pair of protrusions 103, 105 is inserted through the elongated slot 65 of the male connector assembly 5, the male TPA device 10 is at a pre-set position or a pre-lock position inside the internal space 88 within the first part 75 of the male connector assembly 5, as shown in FIG. 9B.

With the male TPA device 10 in a pre-lock position, the male connector assembly 5 is readily transported as a single unit, along with the male TPA device 10.

Figure 9C:
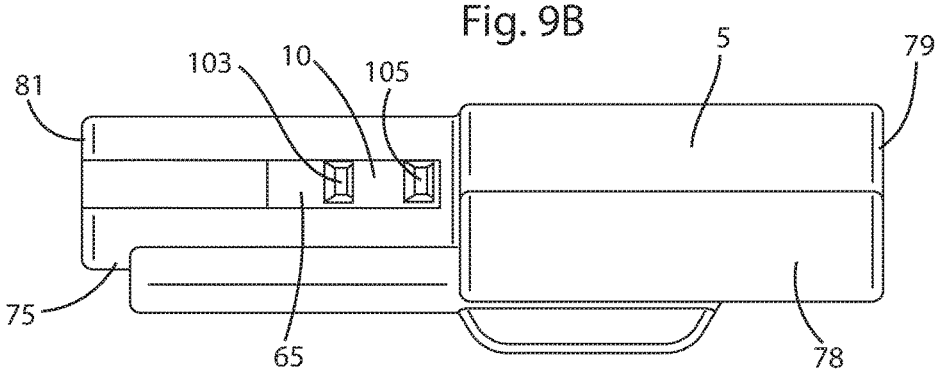
FIG. 9C is a side elevational view of the male connector assembly having its TPA at a full-lock position.

When the male TPA device 10 is further pushed, again either independently with a device or by the female connector assembly 3, the pair of protrusions 103, 105 is inserted through the elongated slot 65 of the male connector assembly 5, as shown in FIG. 9C. Consequently, the male TPA device 10 is at a full-lock position inside the internal space 88 within the first part 75 of the male connector assembly 5. With the male TPA device 10 being in full-lock position with the male connector assembly 5, the male TPA device 10 pushes the flexible lance members 84, which in turn crimp the set of terminals (not shown) inserted into a set of terminal apertures at the end portion 81 of the male connector assembly 5 when the male TPA device 10 is inserted through the opening 80 (at the end portion 79) and onto the flexible lance members 84, at a full-lock position, with the pair of protrusions 103, 105 having been fully inserted through the elongated slot 65 of the male connector assembly 5. With the crimping of the set of terminals, after having the male TPA device 10 at full-lock position, the connection of the set of terminals to the male connector assembly 5 is assured.

Figure 10A:
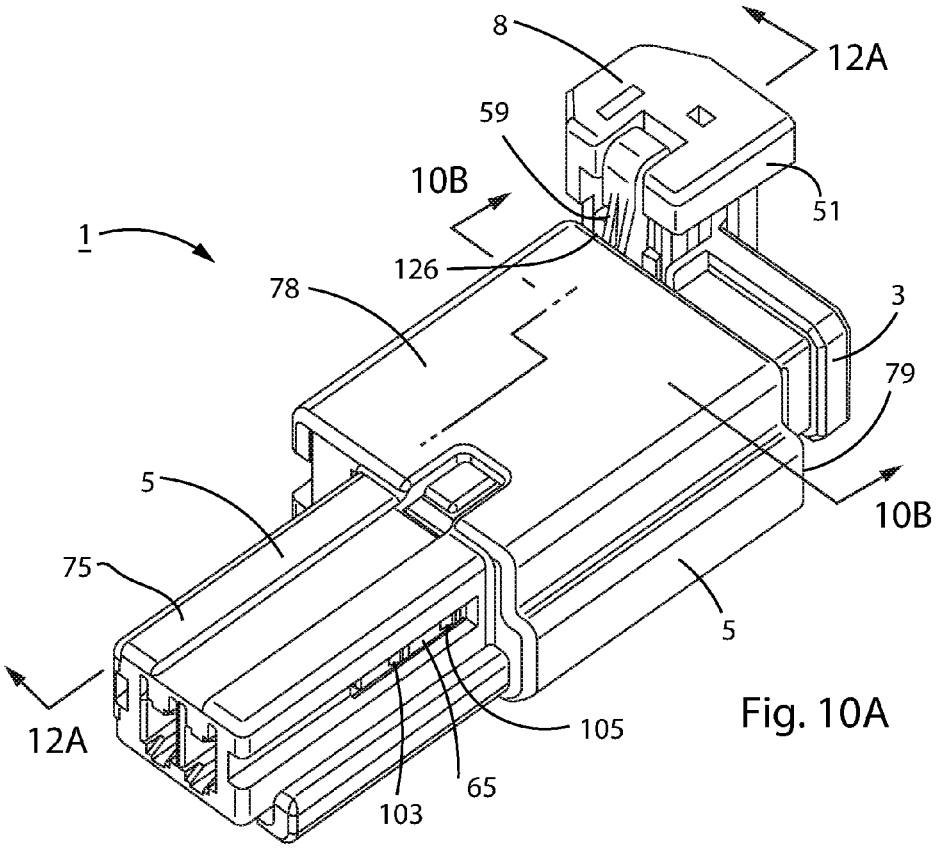
FIG. 10A is a top perspective view of the connector apparatus of this invention with its male and female connector assemblies fully assembled and their respective TPAs at full-lock positions therein and with the CPA at a pre-set position or a pre-lock position.

FIG. 10A illustrates the connector apparatus 1 with its female connector assembly 3 and male connector assembly 5 fully assembled and their female TPA device 6 and male TPA device 10, respectively, at full-lock positions therein and with the CPA device 8 at a partial-lock position. With the female connector assembly 3 fully inserted into the male connector assembly 5, shown in FIG. 10A are the first part 75 and the second part 78 of the male connector assembly 5, and the female connector assembly 3 extending from the end portion 79 of the male connector assembly 5. Also shown in FIG. 10A are the pair of protrusions 103, 105 of the male TPA device 10, both protrusions 103, 105 having been fully inserted into the first side elongated slot 65 of the first part 75 of the male connector assembly 5 and extending out through the first side elongated slot 65 of the male connector assembly 5.

An upper part 126 of the male connector assembly 5 has depressed inward the flexible leg 59 of the CPA device 8. When the flexible leg 59 of the CPA device 8 has moved inward, the CPA device 8 is pushed, through the corner slot 20 of the female connector assembly 3, into a final-lock position. (See, also, FIGS. 12A and 12B.)

Figure 10B:
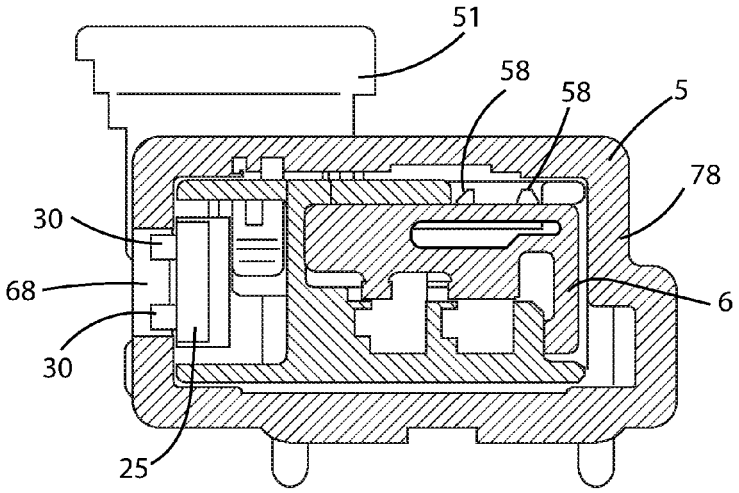
FIG. 10B is a cross-sectional view, taken along line 10B-10B in FIG. 10A of the connector apparatus, showing the TPAs thereof at full-lock positions and the CPA thereof at a pre-set position or a pre-lock position.

FIG. 10B is a cross-sectional view, taken along line 10B-10B in FIG. 10A, showing the CPA device 8 at a pre-set position or a pre-lock position. Further shown in FIG. 10B are the pair of protruding members 30 of the elongated flexible member 25 of the female connector assembly 3 having been fully inserted into the second part 78 of the male connector assembly 5 and extending through the second side elongated slot 68 of the second part 78 of the male connector assembly 5. FIG. 10B also illustrates the female TPA device 6 in a full-lock position, as discussed above with respect to FIG. 8B.

Figure 11A:
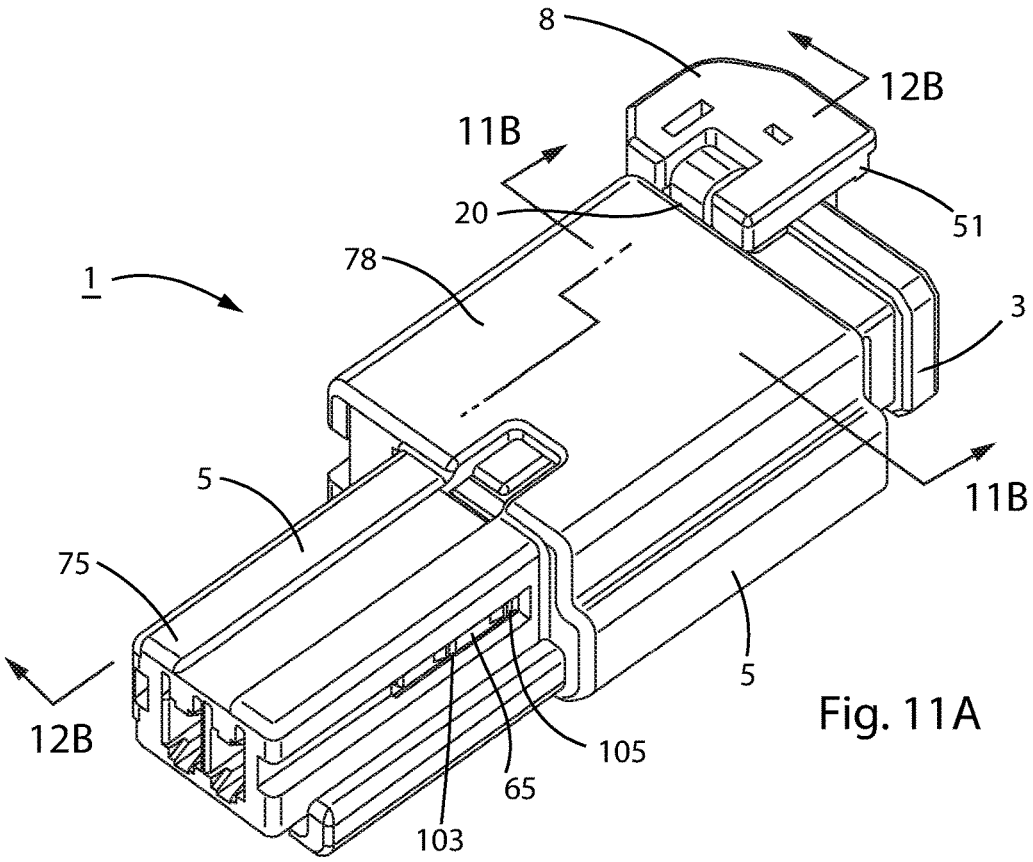
FIG. 11A is a top perspective view of the connector apparatus of this invention with its male and female connector assemblies fully assembled and their respective TPAs at full-lock positions therein and with the CPA at a full-lock position.
Figure 11B:
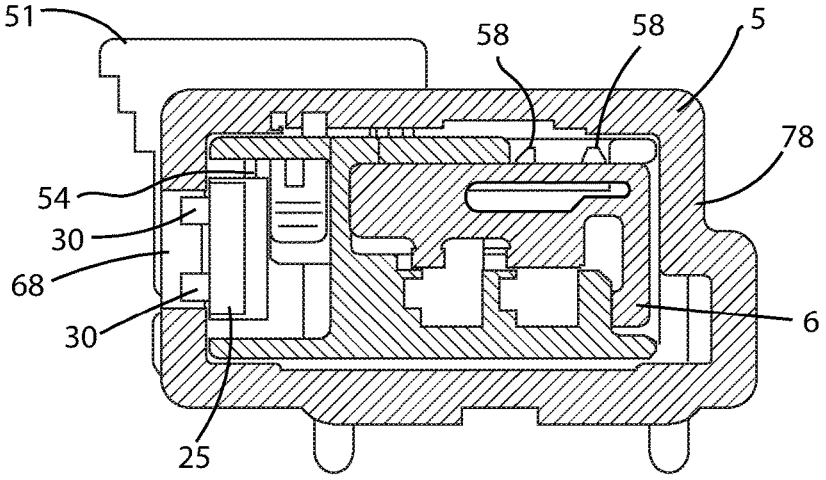
FIG. 11B is a cross-sectional view, taken along line 11B-11B in FIG. 11A of the connector apparatus, showing the TPAs thereof at full-lock positions and the CPA thereof at a full-lock position.

FIGS. 11A and 11B show the connector apparatus 1 with its male and female connector assemblies 3, 5 fully assembled and their respective TPA devices 6, 10 at full-lock positions therein and with the CPA device 8 at a full-lock position. That is, FIGS. 11A and 11B are similar to what is shown in FIGS. 10A and 10B, except that in FIGS. 11A and 11B, the CPA device 8 is at a full-lock position. Here, the CPA device 8, along with its first leg portion 52, and flexible leg 59, are fully inserted through the corner slot 20 of the female connector assembly 3, while the second leg portion 54 and the third leg portion 56 straddle the elongated flexible member 25 of the female connector assembly 3 so that the second leg portion 54 (more specifically, the short portion 66 of the second leg portion 54) of the CPA device 8 blocks the elongated flexible member 25 of the female connector assembly 3 from moving inward such that the pair of protruding members 30 of the elongated flexible member 25 extend sideways or outward through the second side elongated slot 68 of the second part 78 of the male connector assembly 5. Moreover, the blocking member 62 of the first leg portion 52 also blocks the flexible member 25 from moving inward, while the ledge portion 69 of the first leg portion 52 abuts against an upper surface of the flexible member 25. With the protruding members 30 extending through the second side elongated slot 68, the full engagement of the female connector assembly 3 into the male connector assembly 5 is assured because the pair of protruding members 30 of the elongated flexible member 25, with the elongated flexible member 25 being blocked by the first leg portion 52 and the second leg portion 54 of the CPA device 8, assures that the female connector assembly 3 cannot be dislodged or removed from the male connector assembly 5.

With the above-described structural arrangements, while the elongated flexible member 25 of the female connector assembly 3 is blocked from moving inward by the second leg portion 54 of the CPA device 8, the third leg portion 56 blocks any possible outward movement of the elongated flexible member 25 of the female connector assembly 3. Thus, the second leg portion 54 and the third leg portion 56 block the elongated flexible member 25 of the female connector assembly 3 from moving inward or outward, which assures that the pair of protruding members 30 of the elongated flexible member 25 remain extended sideways or outward through the second side elongated slot 68 of the second part 78 of the male connector assembly 5, which subsequently assures that the female connector assembly 3 cannot be dislodged or removed from the male connector assembly 5.

It is noted that the shape of the corner slot 20 substantially resembles the cross-sectional shapes of the first leg portion 52 and the flexible leg 59 (with the cross-section taken along an upper section of the flexible leg 59) of the CPA device 8.

Figure 12A:
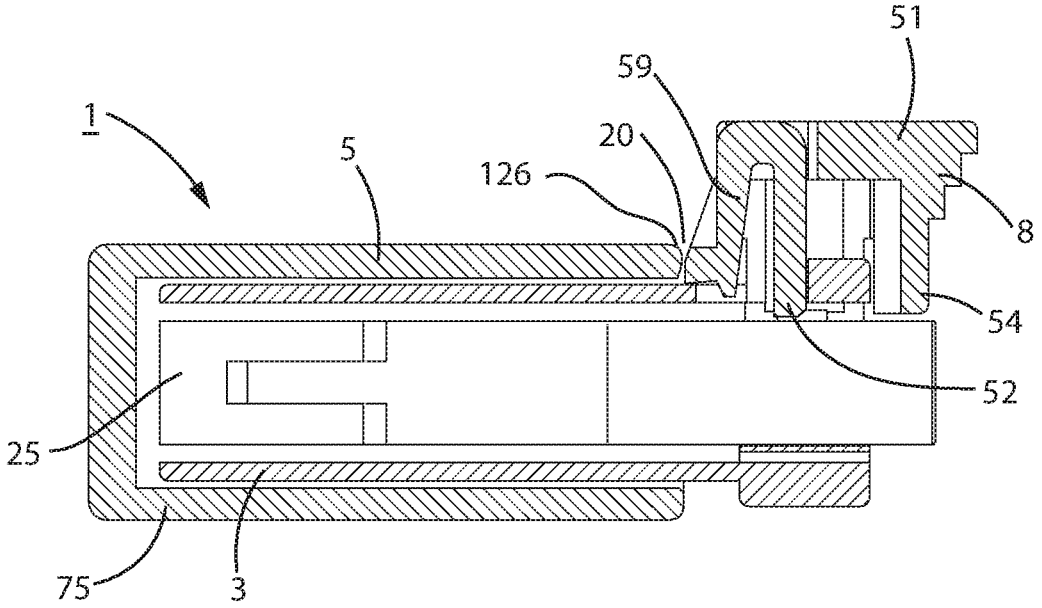
FIG. 12A is a cross-sectional view, taken along line 12A-12A in FIG. 10A, showing the assembled connector apparatus with its CPA at a partial-lock position.

FIG. 12A is a cross-sectional view, taken along line 12A-12A in FIG. 10A, showing the assembled connector apparatus 1 with its CPA device 8 at a pre-set position or a pre-lock position. Shown here are the first leg portion 52, the second leg portion 59, and the flexible leg 59 of the CPA device 8 waiting to be fully inserted into the corner slot 20 of the female connector assembly 3. An upper part 126 of the male connector assembly 5 has depressed inward the flexible leg 59 of the CPA device 8. When the flexible leg 59 of the CPA device 8 has moved inward (FIG. 12A), the CPA device 8 is pushed, through the corner slot 20 of the female connector assembly 3, into a final-lock position (FIG. 12B.)

Figure 12B:
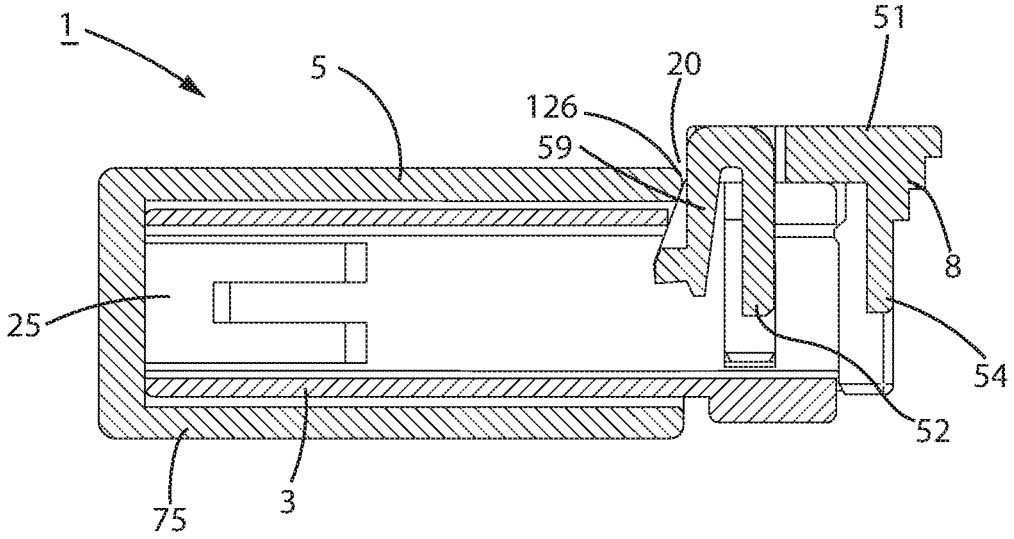
FIG. 12B is a cross-sectional view, taken along line 12B-12B in FIG. 11A, showing the assembled connector apparatus with its CPA at a full-lock position.

FIG. 12B is a cross-sectional view, taken along line 12B-12B in FIG. 11A, showing the assembled connector apparatus 1 with its CPA device 8 at a full-lock position. Shown here are the first leg portion 52, the second leg portion 59, and the flexible leg 59 of the CPA device 8 fully inserted through the corner slot 20 of the female connector assembly 3. The CPA device 8 is locked within female connector assembly by its flexible leg 59. With the second leg portion 54 of the CPA device 8, now fully inserted through the corner slot 20, the second leg portion 54, as discussed above with respect to FIGS. 11A and 11B, blocks the elongated flexible member 25 of the female connector assembly 3 from moving inward such that the pair of protruding members 30 of the elongated flexible member 25 extend sideways or outward through the second side elongated slot 68 of the second part 78 of the male connector assembly 5. As described above, with respect to FIGS. 11A and 11B, with the protruding members 30 extending through the second side elongated slot 68, the full engagement of the female connector assembly 3 into the male connector assembly 5 is assured.

Figure 13A:
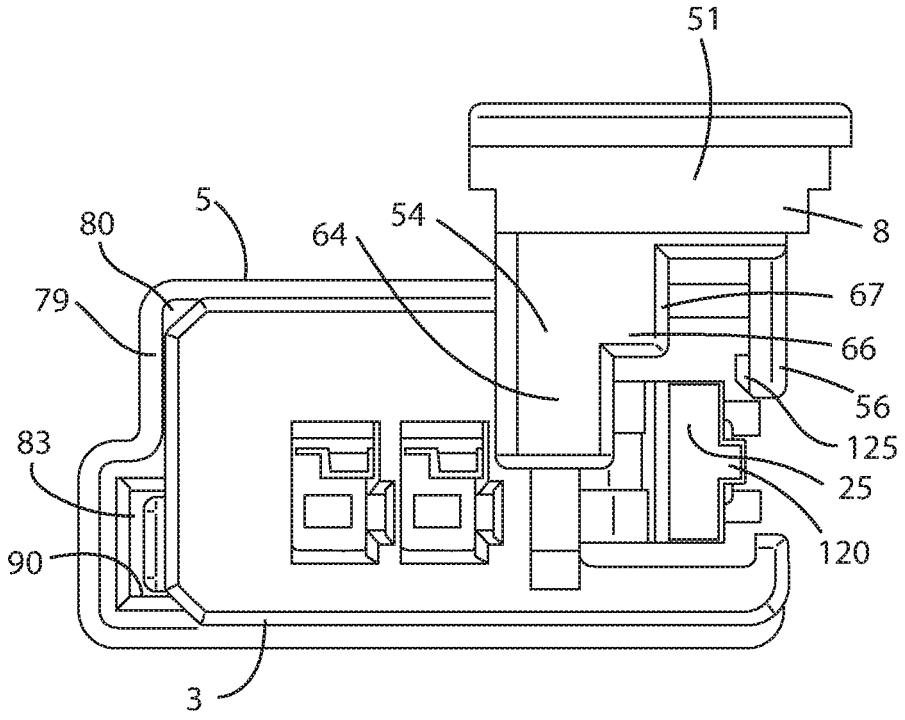
FIG. 13A is a side end elevational view of the assembled connector apparatus with its CPA at a pre-set position or a pre-lock position.

FIG. 13A is a side end elevational view of the assembled connector apparatus 1 with its CPA device 8 at a pre-set position or a pre-lock position, which is viewed from the end portion 79 and through the opening 80 of the male connector assembly 5. With the ledge portion 32 of the female connector assembly 3 having been fully guided by the U-shaped side portion 90 of the opening portion 83 of the male connector assembly 5, the female connector assembly 3 has been fully inserted into the male connector assembly 5.

Figure 13B:
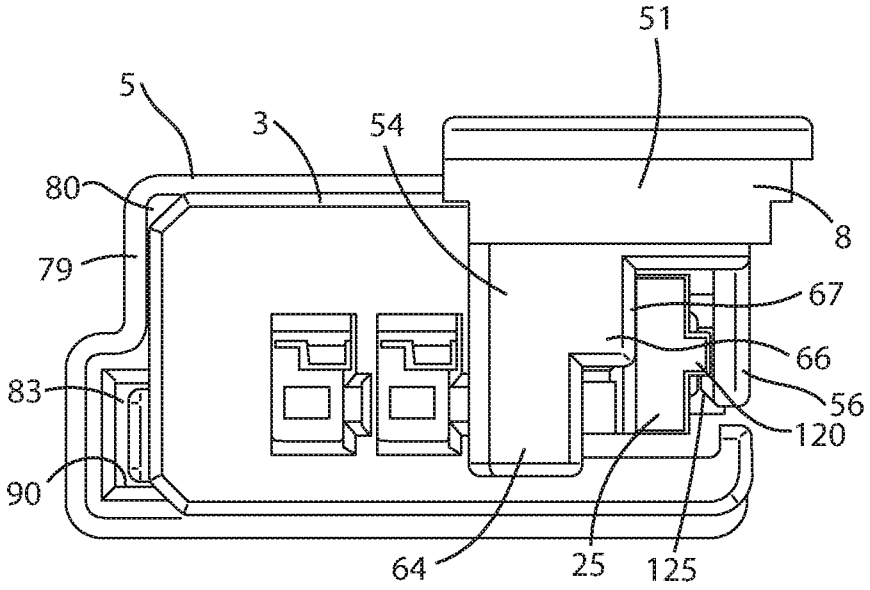
FIG. 13B is a side end elevational view of the assembled connector apparatus with its CPA at a full-lock position.

FIG. 13B is a side end elevational view of the assembled connector apparatus 1 with its CPA device 8 at a full-lock position. The second leg portion 54 and the third leg portion 56 of the CPA device 8 are shown as locking the elongated flexible member 25 of the female connector assembly 3 in place. More particularly, the short portion 66 of the second leg portion 54 directly abuts against the elongated flexible member 25 on one side thereof, while the third leg portion 56 directly abuts against a protrusion 120 of the elongated flexible member 25 on another side thereof. Assuring that the elongated flexible member 25 is locked in place, a hook portion 125 extending at a bottom portion of the third leg portion 56 engages a bottom portion of the protrusion 120 of the elongated flexible member 25. With the assurance that the elongated flexible member 25 is blocked from being moved inward and is fully locked in place, it is assured that the pair protruding members 30 of the elongated flexible member 25 of the female connector assembly 3 remain inserted into the second part 78 of the male connector assembly 5 and remain extended through the second side elongated slot 68 of the second part 78 of the male connector assembly 5, which assures that the female connector assembly 3 remains engaged with the male connector assembly 5.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

We claim:

1. A connector apparatus, comprising:

a female connector assembly having a set of terminal apertures for receiving therein at least a set of terminals, wherein the female connector assembly comprises a top side having a top slot and a side having a side slot, and wherein the female connector assembly further comprises a female terminal position assurance (TPA) device accommodated within the side slot and a connector position assurance (CPA) device accommodated within the top slot; and a male connector assembly having a set of terminal apertures for receiving therein a set of other terminals, wherein the male connector assembly comprises an opening for receiving a male terminal assurance (TPA) device and the female connector assembly.

2. The connector apparatus as in claim 1, wherein the female TPA device includes members for allowing the female TPA device to be at a pre-set position or a pre-lock position during transport of the female connector assembly and at a full-lock position for engaging the set of terminals.

3. The connector apparatus as in claim 2, wherein the CPA device includes legs for allowing the CPA device to be at a pre-set position or a pre-lock position during transport of the female connector assembly and at a full-lock position for engaging the female connector assembly with the male connector assembly.

4. The connector apparatus as in claim 2, wherein the male TPA device includes members for allowing the male TPA device to be at a pre-set position or a pre-lock position during transport of the male connector assembly and at a full-lock position for engaging the set of other terminals.

5. A female connector assembly, comprising:

a top side having a top slot;

a side having a side slot;

a female terminal position assurance (TPA) device accommodated within the side slot; and a connector position assurance (CPA) device accommodated within the top slot.

6. The female connector assembly as in claim 5, wherein the female TPA device includes members extending therefrom for allowing the female TPA device to be at a pre-set position or a pre-lock position during transport of the female connector assembly and at a full-lock position for engaging a set of terminals.

7. The female connector assembly as in claim 6, wherein when the female TPA device is in full-lock position, the CPA device assures, when in full-lock position, the engagement of the female connector assembly with a male connector assembly.

8. A male connector assembly, comprising:

a first end; and a second end, having a set of apertures for accommodating therein a set of terminals, wherein the first end includes at least an opening for receiving therein a male terminal position assurance (TPA) device, wherein the second end includes a slot passing through at least one side thereof, wherein the male TPA device includes a pair of protrusions on at least one side thereof, wherein when one protrusion of the pair of protrusions is inserted through the slot, the male TPA device is at a pre-lock position with the male connector assembly, and wherein when the pair of protrusions is inserted through the slot, the male TPA device is at a full-lock position with the male connector assembly.

9. The male connector assembly as in claim 8, wherein the male TPA device includes members, extending therefrom, for allowing the male TPA device to be at a pre-set position or a pre-lock position during transport of the male connector assembly and at a full-lock position for engaging the set of terminals.

10. The male connector assembly as in claim 9, wherein, when the male TPA device is in a full-lock position, a female connector assembly can be inserted and accommodated within the opening of the second end and a connector position assurance (CPA) device inserted into the female connector assembly, when in full-lock position, for assuring that the female and male connector assemblies remain engaged.

11. A connector position assurance (CPA) device for engaging a female connector assembly and male connector assembly in a connector apparatus, comprising:

an upper portion; and a plurality of legs extending from the upper portion, wherein a number of the plurality of legs are inserted into a side of a connector apparatus for securing the engagement of female and male connector assemblies, wherein at least one leg among the plurality of legs blocks the movement of a flexible member of the female connector assembly, when the CPA device is in full-lock position, for assuring that the female connector assembly remains engaged with the male connector assembly.

12. The connector position assurance (CPA) device as in claim 11, wherein the plurality of legs include a first leg portion, a second leg portion, a third leg portion, and flexible leg, wherein the first leg portion and the flexible leg are inserted into the side of the connector apparatus.

13. The connector position assurance (CPA) device as in claim 12, wherein the first leg portion and the flexible leg are inserted into a corner slot of the side of the connector apparatus.

14. The connector position assurance (CPA) device as in claim 12, wherein the first leg portion and the flexible leg are inserted into a corner slot of a top side of the female connector assembly.

15. The connector position assurance (CPA) device as in claim 12, wherein when the male connector assembly depresses inward the flexible leg, the CPA device is pushed through into a final-lock position.

16. The connector position assurance (CPA) device as in claim 13, wherein the second leg portion and the third leg portion block the movement of the flexible member of the female connector assembly, when the CPA device is in full-lock position, for assuring that the female connector assembly remains engaged with the male connector assembly.

17. The connector position assurance (CPA) device as in claim 15, wherein the second leg portion blocks the member of the female connector assembly from moving inward, while the third leg portion blocks the member of the female connector assembly from moving outward, when the CPA device is in full-lock position, for assuring that the female connector assembly remains engaged with the male connector assembly.

18. The connector position assurance (CPA) device as in claim 13, wherein the first leg portion blocks the member of the female connector assembly from moving inward, when the CPA device is in full-lock position, for assuring that the female connector assembly remains engaged with the male connector assembly.

19. The connector position assurance (CPA) device as in claim 17, wherein the first leg portion includes a blocking member from blocking the member of the female connector assembly from moving inward, and further includes a ledge portion for abutting against an upper surface of the member of the female connector assembly, when the CPA device is in full-lock position, for assuring that the female connector assembly remains engaged with the male connector assembly.

20. A method for assembling a connector apparatus, comprising the steps of:

providing a female connector assembly having a set of terminal apertures for receiving therein at least a set of terminals;

accommodating a female terminal position assurance (TPA) device within a side slot of the female connector assembly;

accommodating a connector position assurance (CPA) device within a top slot of the female connector assembly;

providing a male connector assembly having a set of terminal apertures for receiving therein a set of other terminals;

accommodating a male terminal position assurance (TPA) device within an opening at an end portion of the male connector assembly;

and accommodating the female connector assembly into the male connector assembly.

21. The method for assembling the connector apparatus as in claim 20, wherein the step of accommodating the female TPA device within the side slot of the female connector assembly further comprises the step of providing the female TPA device with members extending therefrom for allowing the female TPA device to be at a pre-set position or a pre-lock position during transport of the female connector assembly and to be at a full-lock position for engaging the set of terminals.

22. The method for assembling the connector apparatus as in claim 20, wherein the step of accommodating the male TPA device further comprises the step of providing members, extending from the male TPA device, for allowing the male TPA device to be at a pre-set position or a pre-lock position during transport of the male connector assembly and at a full-lock position for engaging the set of other terminals.

23. The method for assembling the connector apparatus as in claim 20, wherein the step of accommodating the CPA device includes the step of providing legs, extending from the CPA device, for allowing the CPA device to be at a pre-set position or a pre-lock position during transport of the female connector assembly and at a full-lock position for engaging the female connector assembly with the male connector assembly.

24. The method for assembling the connector apparatus as in claim 23, wherein the step of accommodating the CPA device includes the steps of: (a) the male connector assembly depressing a leg of the CPA device, and (b) pushing the CPA device into the full-lock position.

25. The method for assembling the connector apparatus as in claim 23, wherein the step of accommodating the CPA device includes the steps of: (a) the male connector assembly depressing a flexible leg of the CPA device, and (b) pushing the CPA device through a slot of female connector assembly into the full-lock position.

* * * * *